US007065849B2

(12) United States Patent
Martinez Choperena

(10) Patent No.: US 7,065,849 B2
(45) Date of Patent: Jun. 27, 2006

(54) METHOD OF PRODUCING WATERPROOF FOAM MATTRESSES

(75) Inventor: Benito Manuel Martinez Choperena, Orcoyen (ES)

(73) Assignee: Perfosistem, S.L., Orcoyen (Navarra) (ES)

( * ) Notice: Subject to any disclaimer, the term of this patent is extended or adjusted under 35 U.S.C. 154(b) by 21 days.

(21) Appl. No.: 10/489,340

(22) PCT Filed: Sep. 12, 2002

(86) PCT No.: PCT/ES02/00427

§ 371 (c)(1),
(2), (4) Date: Sep. 9, 2004

(87) PCT Pub. No.: WO03/022103

PCT Pub. Date: Mar. 20, 2003

(65) Prior Publication Data

US 2005/0019489 A1 Jan. 27, 2005

(30) Foreign Application Priority Data

Sep. 13, 2001 (ES) ..... 200102059

(51) Int. Cl.
*B68G 7/00* (2006.01)

(52) U.S. Cl. ..... 29/91.1; 29/91.7; 29/557; 29/558; 5/699; 5/704; 5/724; 427/346; 427/541

(58) Field of Classification Search ..... 29/91.1, 29/91.7, 557, 558; 5/699, 692, 694, 704, 5/724; 427/244, 246, 346, 541
See application file for complete search history.

(56) References Cited

U.S. PATENT DOCUMENTS

| | | | | |
|---|---|---|---|---|
| 376,094 | A * | 1/1888 | Hurlburt | 5/641 |
| 510,490 | A * | 12/1893 | Sternberger | 5/724 |
| 865,585 | A * | 9/1907 | Groskopf | 5/724 |
| 932,024 | A * | 8/1909 | Kalas et al. | 5/716 |
| 1,727,961 | A * | 9/1929 | Brown | 5/724 |
| 1,980,445 | A * | 11/1934 | Sherover | 5/724 |
| 3,209,380 | A * | 10/1965 | Watsky | 5/724 |
| 5,430,901 | A | 7/1995 | Farley | |
| 6,055,690 | A * | 5/2000 | Koenig | 5/724 |
| 6,061,856 | A * | 5/2000 | Hoffmann | 5/728 |
| 6,131,220 | A * | 10/2000 | Morimura | 5/652.1 |
| 6,484,340 | B1 * | 11/2002 | Kutschi | 5/716 |

FOREIGN PATENT DOCUMENTS

| | | |
|---|---|---|
| EP | 1454572 A1 * | 9/2004 |
| ES | 1 011 364 | 3/1990 |
| ES | 1 028 212 | 12/1994 |
| ES | 1 042 871 | 10/1999 |

(Continued)

*Primary Examiner*—Essama Omgba
(74) *Attorney, Agent, or Firm*—Nath & Associates PLLC; Gary M. Nath; Gregory B. Kang

(57) ABSTRACT

Production process for waterproofed foam mattresses, starting from a foam material body (1) in which a plurality of passing through holes (2) are carried out in the bigger faces and some passing through holes (3) with a smaller diameter are carried out along the body (1), through which holes (3) some rods (4) are incorporated to be fastened on a supporting frame (5), and to spray the body (1) in this position with the waterproofing material, letting the latter drip off in a sloped position till the mentioned waterproofing material is gelled.

11 Claims, 3 Drawing Sheets

FOREIGN PATENT DOCUMENTS

| | | | | |
|---|---|---|---|---|
| ES | 1 046 153 | | | 11/2000 |
| GB | 1 588 941 | | | 5/1981 |
| GB | 2235130 | A | * | 2/1991 |
| WO | 2003022103 | A1 | * | 3/2003 |

* cited by examiner

METHOD OF PRODUCING WATERPROOF FOAM MATTRESSES

BACKGROUND OF THE INVENTION (1) Field of the Invention

The present invention refers to a production process for mattresses made up of a body of foam material with a waterproofing covering on the outer surface.

(2) Description of the Related Art

Mattresses made up of a foam rubber body are already known, either in an only piece or in layers joined in a sandwiched way; the foam material can be polyurethane, latex or a combination of these or other materials.

The practice of carrying out transverse openings in the foam rubber body of the mattresses is also known, to ease up the ventilation of the surface supporting the user, as for example according to the Spanish Utility Models 8902662, 9901047 and 200001179.

The incorporation of a waterproofing covering on the outer surface of the foam rubber body of the indicated mattresses is again known, according to the same mentioned Utility Models, so as to avoid the penetration of humidity in the same, either by the user's sweat or when it is cleaned.

BRIEF SUMMARY OF THE INVENTION

According to the object of the present invention a process is proposed for the production of this kind of mattresses, by means of which a simple easy realization is reached, resulting moreover highly positive for the mentioned mattresses.

This process, the object of the invention, starts from a foam body with the dimensions of the mattress to be made, perforating the mentioned body between the bigger faces with a plurality of passing holes, which are carried out with a hollow cylindrical drill, while at the side some holes with a smaller diameter are carried out in the foam body, through which some rods are passed to fix the foam body with respect to a supporting frame, and in this disposition the foam body is sprayed with a mixture of latex, being situated after the supporting frame, with the foam body in an inclined position so as to drain off the excess of latex mixture and finally it is dried in an oven.

After the drying, the mattress body is taken off the supporting frame, and at the ends of the side holes some valves are glued, which are susceptible of being closed provisionally by means of blanking plugs.

This way a mattress is obtained which is perfectly waterproofed, for its use and with a realization which makes it very comfortable, as the passing through holes between the bigger faces make the foam body more fluffed up, easing up at the same time the ventilation of the surface supporting the user, while the side holes, which can be left uncovered when the mattress is used, cooperate in the comfort, easing up the evacuation of the air inside the foam body when the user leans on the mattress, while to clean the mattress, the mentioned side holes can be plugged up so that no water can penetrate inside the foam body.

The production process, on the other hand, is very simple, allowing the application of an exterior waterproofing covering on the foam body without having to touch the latter at all during the process.

In view of all this, the mentioned process, object of the invention certainly has some very advantageous features, acquiring own life and preferable character in its application.

DETAILED DESCRIPTION OF THE INVENTION

The object of the invention refers to a production process for mattresses made up of a foam material body, foreseen of ventilation holes and with a waterproofing covering on the outer surface.

The process is developed starting from a foam material body (1), with the dimensions of the mattress to be produced, the mentioned body (1) can be an only piece or it can be made up of layers joined in a sandwiched way, while the material can be any susceptible of foaming used for this kind of objects, such as latex, polyurethane, etc . . . or combinations of the mentioned products.

Some passing through holes (2) are carried out in the mentioned body (1) between the bigger faces, the mentioned holes are made by means of a hollow cylindrical drill. The distribution and the number and diameter of these holes (2) can vary according to the mattress to achieve.

Through the mentioned body (1) some side holes (3) are moreover carried out, which pass it from side to side, and which are carried out in the same way as the holes (2), but with a smaller diameter.

Figure 1:
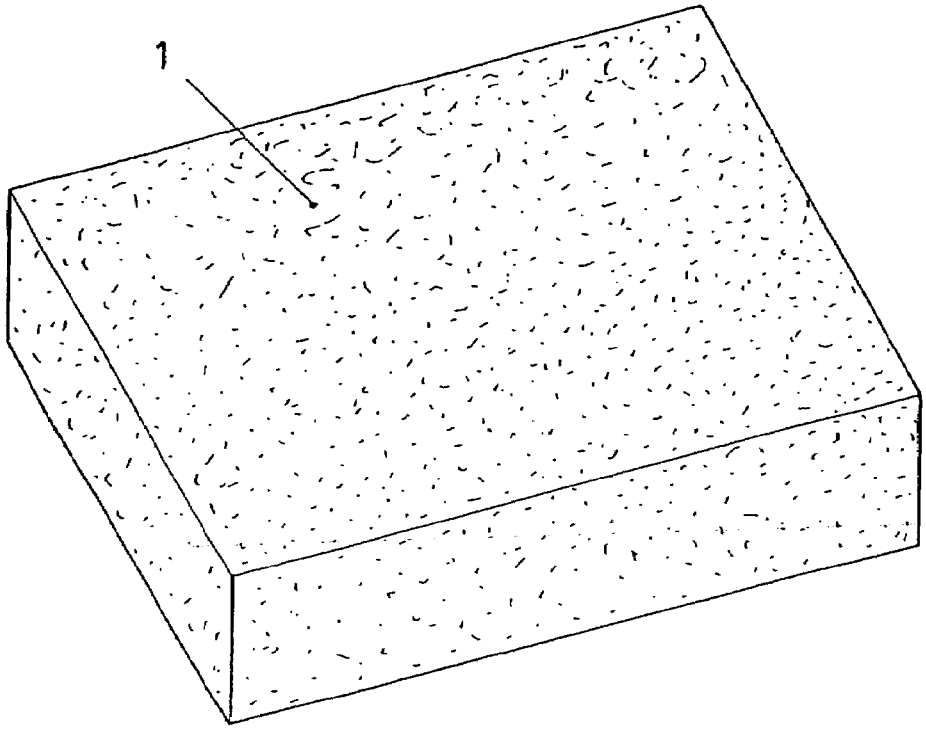
FIG. 1 shows a foam body in perspective for the process of the invention.
Figure 2:
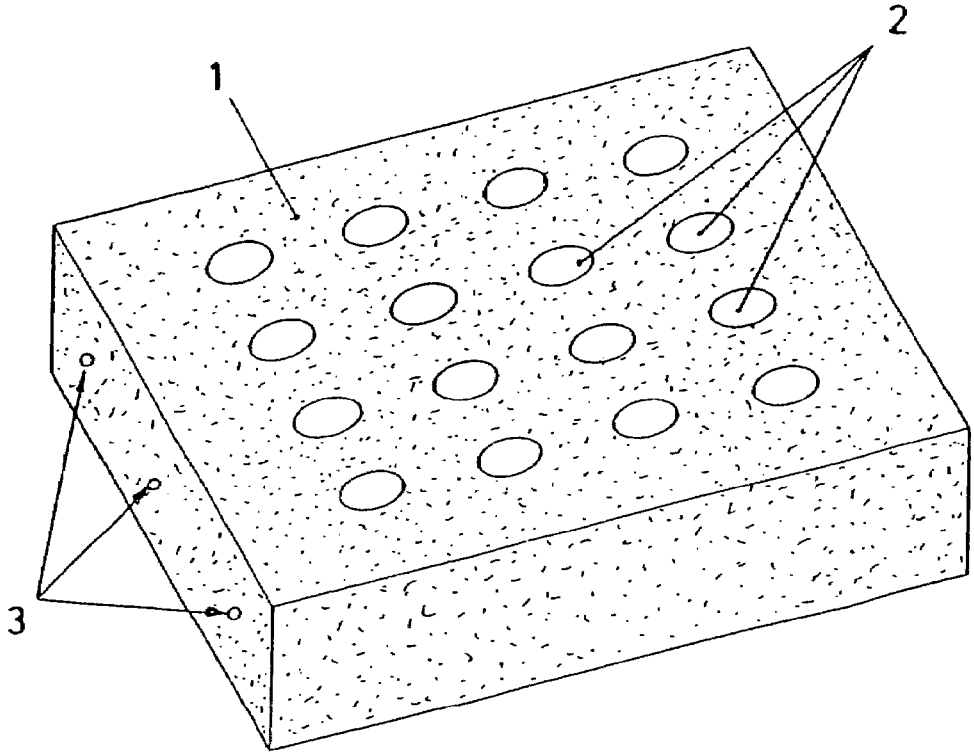
FIG. 2 is a perspective of the foam body after carrying out the transverse and side holes in it.
Figure 3:
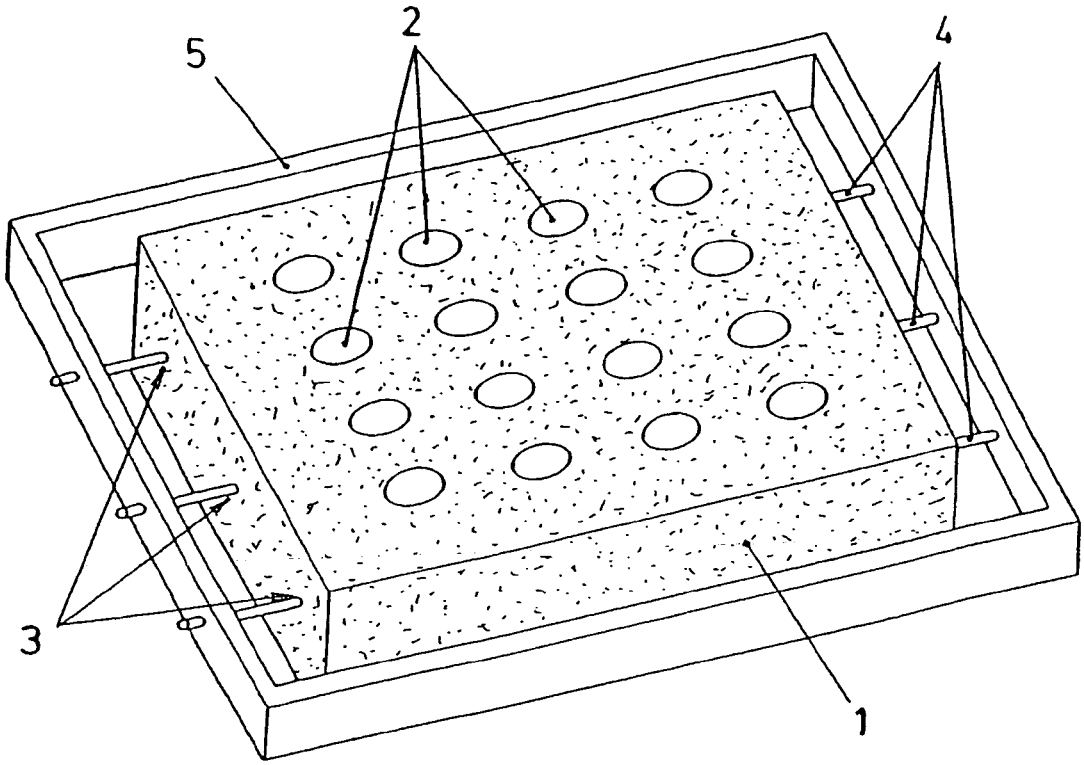
FIG. 3 represents a perspective of the foam body disposition on the supporting frame to apply the waterproofing covering.
Figure 4:
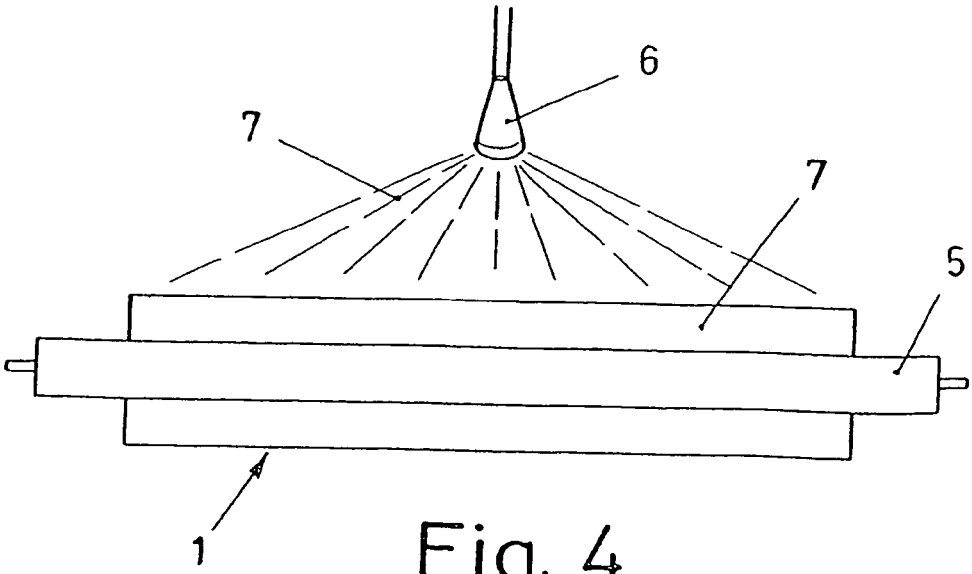
FIG. 4 is a side view showing in a schematic way the application of the waterproofing covering on the foam body.

The number of the mentioned side holes can also vary, there can, for example, be three or four of them, and their function is to introduce some rods (4) through them, these rods can be made of stainless steel for instance, to fasten the body (1) respect to a supporting frame (5), in the way represented on FIG. 3.

In this disposition, the body (1) can be manipulated without the need to touch it, to spray a waterproofing product (7) on it, by means of a projector (6).

The product (7) of waterproofing material that is used for this end is a mixture of latex, made up of 100% natural and/or artificial latex, vulcanizing pasta, thickener, antioxidant, bactericide, titanium, wax and colouring agent; carrying out the mentioned mixture for the application with a viscosity of 45–50 seconds per quarter, preferably around 45 seconds per quarter. A proportion of 87% of latex, 6% of vulcanizing pasta, 6% of thickening agent, 0.5% of titanium, 0.25% of bactericide and 0.25% of colouring agent.

The application of the mentioned waterproofing mixture (7) is carried out with an air pump under pressure of 3–4 kilos, preferably around 4 kilos but without exceeding the mentioned pressure, so to avoid the mixture (7) to penetrate in the foaming material of the body (1). The mentioned application is carried out from a height of 15–20 centimeters, preferably around 20 centimeters but without exceeding the mentioned height, also to avoid the penetration of the mixture (7) in the foam material of the body (1).

Figure 5:
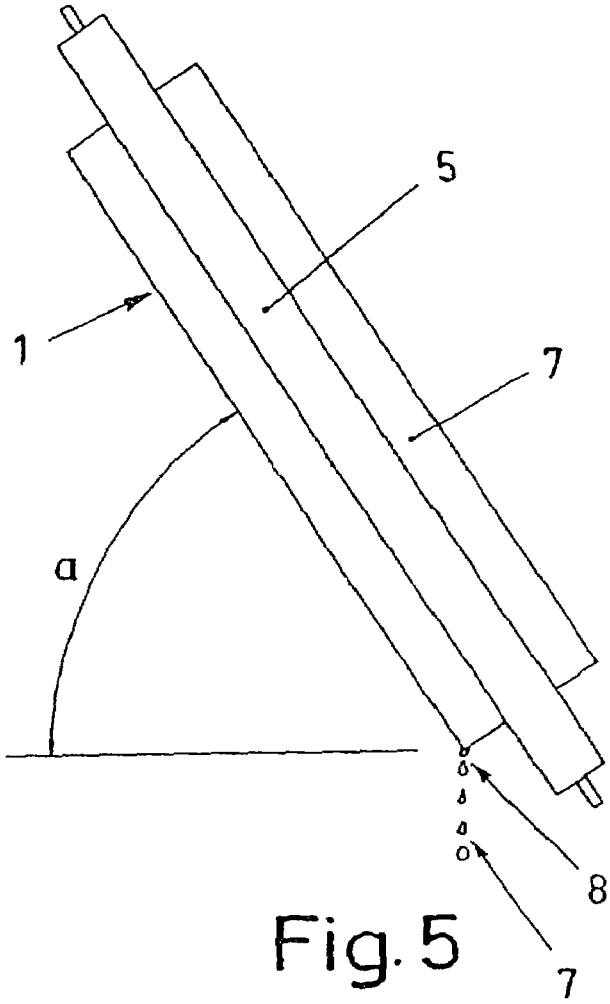
FIG. 5 is a side view of the disposition for the draining off of the waterproofing applied on the foam body.
Figure 6:
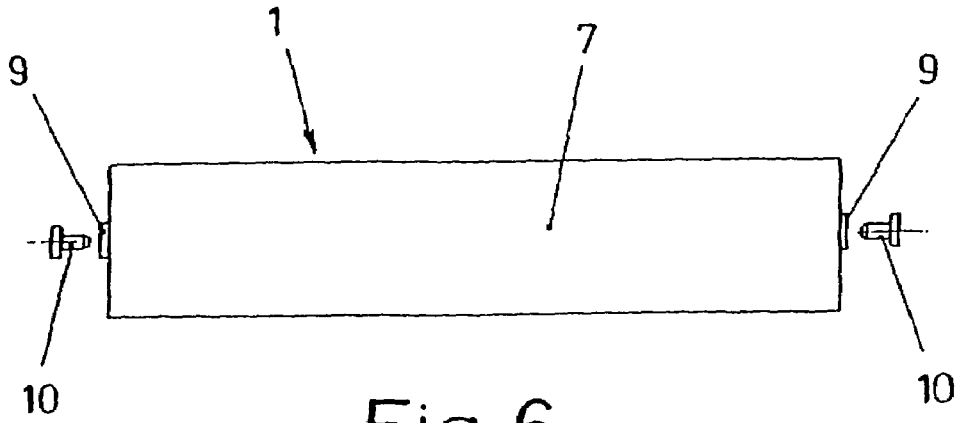
FIG. 6 is a side view of the mattress body in the final disposition with the valves incorporated at the ends of the side holes.

Once the waterproofing mixture (7) has been applied, the sprayed body (1) is situated, by means of the supporting frame (5), in an inclined position in the way shown on FIG. 5, in which the applied mixture (7) drains off, perfectly covering the surface of the body (1) and dripping off the excess.

The sloping angle (a) for the draining is 57–60°, having verified that the ideal angle for a preferable viscosity of 45 seconds per quarter is 57°, at which the applied mixture (7) flows in a fluid way along the surface of the body (1) without accumulating anywhere, remaining only drops (8) at the lower edges, and which are easy to take away manually afterwards.

The draining phase is maintained for 6–7 hours, time during which the pre-drying of the waterproofing mixture (7) is carried out, resulting the latter gelled.

After this draining and pre-drying period, a drying in oven at a temperature of 80–120° C., preferably around 80° C., is carried out in an environment with continuous dry hot air current.

Once the mixture (7) applied on the body (1) is dry, the latter is dismounted from the supporting frame (5), taking away the rods (4), with which the side holes (3) remain free.

When the mattress is finished off, respect to the ends of the mentioned side holes (3), some valves (9) are glued in, which allow their closure by means of the corresponding plugs (10), in such a way that the mentioned plugs (10) are taken away when the mattress is used, so that the air can flow out freely from inside the body (1) when the user leans on it, making its use more comfortable, while when the mattress is cleaned, the plugs (10) can be put in so as to avoid the entrance of water inside the foam body (1).

The production process, according to what is described, which correspond to the object of the invention, can in any case be used applicable for mattresses for beds of any size, as well as for pillows, cushions or any other element whose end is to ease up the user's commodity by means of a fluffed up support.

The invention claimed is:

1. A production process for waterproof foam mattresses comprising a foam material body with ventilation holes and a waterproofing covering, the process comprising:

providing a foam material body having the size of a mattress to be made, the foam material body comprising large top and bottom faces and four lateral faces;

forming a plurality of through holes between the top and bottom faces using a hollow cylindrical drill;

drilling longitudinal through holes between two of the lateral sides of the foam material body, the longitudinal through holes having a diameter smaller than a diameter of the plurality of through holes;

inserting metal rods in the longitudinal through holes such that ends of the rods protrude from the foam material body, and fixing the protruding ends on a maneuvering supporting frame;

spraying the foam material body with a waterproofing material while the foam material body is held on the supporting frame by the rods;

tilting the sprayed foam material body held on the supporting frame to an inclined position thereby letting excess waterproofing material drip off and holding the sprayed foam material body on the supporting frame until the waterproof material is gelled, and drying the sprayed foam material body in an oven.

2. The production process of claim 1, characterized in that the waterproofing material is a mixture of 100% natural and/or artificial latex, vulcanizing pasta, thickener, antioxidant, bactericide, titanium, wax and colouring agent, the mixture having a viscosity of 45–50 seconds per quarter.

3. The production process of claim 2, in which the mixture has a viscosity of45 seconds per quarter.

4. The production process of claim 1, characterized in that the waterproofing material is applied at a pressure of 3–4 kilos, without exceeding this pressure, and from a height of 15–20 centimetres, without surpassing this height.

5. The production process of claim 4, characterized in that the waterproofing material is applied at a pressure of 4 kilos.

6. The production process of claim 4, characterized in that the waterproofing material is applied from a height of 20 centimeteres.

7. The production process of claim 1, characterized in that the draining angle of the waterproofing material, after its application, is of 57–60°, maintaining this position for a time of 6–7 hours so that the material is allowed to gel.

8. The production process of claim 7, characterized in that the draining angle of the waterproofing material after its application is 57°.

9. The production process of claim 1, characterized in that the sprayed foam material body is dried at a temperature of 80–120° C. in an environment with continuous dry hot air current.

10. The production process of claim 9, characterized in that the sprayed foam material body is dried at a temperature of 80° C.

11. The production process of claim 1, further comprising:

dismounting the supporting frame, and gluing valves to the longitudinal through holes, the valves being closable by withdrawable plugs.

* * * * *